US006439414B1

(12) United States Patent
Liu

(10) Patent No.: US 6,439,414 B1
(45) Date of Patent: Aug. 27, 2002

(54) STRUCTURE OF FOLDABLE RECEIVING BIN

(75) Inventor: Cheng-Chia Liu, Chung-Li (TW)

(73) Assignee: Shih Tai Plastics Industrial Co., Ltd., Chung-Li (TW)

( * ) Notice: Subject to any disclaimer, the term of this patent is extended or adjusted under 35 U.S.C. 154(b) by 0 days.

(21) Appl. No.: 09/867,414

(22) Filed: May 31, 2001

(51) Int. Cl.[7] ..... A65D 19/18
(52) U.S. Cl. ..... 220/7
(58) Field of Search ..... 220/6, 7, 4, 28

(56) References Cited

U.S. PATENT DOCUMENTS 1,236,831 A * 6/1917 Ickes ..... 220/7
1,301,650 A * 4/1919 Chapman ..... 220/7
1,345,264 A * 6/1920 Shirczy ..... 220/7
4,735,331 A * 4/1988 Keenan et al. ..... 220/7
5,125,524 A * 6/1992 Hosoda et al. ..... 220/7
5,323,921 A * 6/1994 Olsson ..... 220/7
5,853,099 A * 12/1998 Lessard ..... 220/7

* cited by examiner

*Primary Examiner*—Joseph M. Moy
(74) *Attorney, Agent, or Firm*—Bacon & Thomas, PLLC

(57) ABSTRACT

An improved structure of foldable receiving bin by which all the side plates of the receiving bin are provided on the connecting ends thereof to an upper frame and a lower base plate of the receiving bin with engaging portions, the receiving bin can be firmly engaged and fixed when it is unfolded or folded; the bin is comprised of a cover plate, an upper frame, a lower base plate, two foldable plates and two lateral side plates. The foldable plates are connected between the upper frame and the lower base plate; while the lateral side plates are pivotally connected beneath the upper frame; the upper frame is pivotally connected with the cover plate which is comprised of a left cover plate and a right cover plate connected by engaging with each other. When the bin is unfolded for use, the engaging portions at the connecting ends between the two foldable plates and the two lateral side plates make the assembly of the receiving bin firm.

7 Claims, 10 Drawing Sheets

STRUCTURE OF FOLDABLE RECEIVING BIN

BACKGROUND OF THE INVENTION

1. Field of the Invention

The present invention is related to an improved structure of foldable receiving bin, and especially to such an improved structure by which all the side plates of the receiving bin are provided on the connecting ends thereof with engaging portions; thereby the receiving bin is firm and not subjected to shaking after assembling thereof, and can be firmly engaged against separating when it is folded to collapse. When the receiving bin is in use, it is not subjected to shaking or tilting; the receiving bin has thereby a firm structure. After collapsing of a plurality of receiving bins, they can be engaged with one another, convenient transporting and storing of the foldable receiving bins can be obtained without the trouble of loosening or separating.

2. Description of the Prior Art

In most factories, stores, department stores etc., receiving bins are always used to receive smaller articles of parts, stocks, products, commodities etc.; thereby, the personnel of stores can conveniently move the goods; using or storing of the receiving bins can be easier, and thereby, the receiving bins have been gradually used in large amount by the factories and stores. Receiving bins more usually used are mostly formed into fixed shaped rectangular containers, their volumes are quite large for putting therein more goods; they occupy more space in transporting or storage goods though, hence amount of them to transport is limited, if the amount is too large, a person moving them with goods will be unstable due to the heavy weight, and thus transporting is time consuming and strength exhaustive. In storing, the receiving bins are all stacked one on the other, the higher the stacking is, the smaller area is occupied, but the center of gravity will be higher and the whole stack will be unstable and is subjected to falling down. In view of this, height of stacking of receiving bins is limited, yet the space occupied by the receiving bins is still quite large, and this leaves a very large trouble to the traders in storing the receiving bins.

To get rid of the defects of large volume and uneasy for storing of receiving bins, there are foldable receiving bins in the markets for the traders to fold them to collapse when not in use, this can reduce volume of receiving bins; however, after collapsing of receiving bins, no direct fixing structure is provided for them, they must be transported directly or under the mode of being tied up with ropes, they are subjected to loosening during transportation to be in the state of only partially folded that renders workers even harder to move them and thus induces more trouble for the workers. In the case of tying with ropes after folding, transportation can be convenient; however, using of the receiving bins will be quite cumbersome, the ropes must be untied before taking the receiving bins for use. When they are to be stored and transported again after using, they shall be tied again; such repeated work tires the workers. And more, when the receiving bins are unfolded, there is no support or fixing structure other than the foldable plates for supporting the upper frames. If the receiving bins are accidentally collided, they will be loosened and collapsed as if they are folded; at this time, if there are many goods in the receiving bins, the goods will be scattered in a mess; therefore, such receiving bins have a lot of defects resided therein and are in haste to be improved.

In view of the above statement, the inventor of the present invention is aware of that receiving bins can be used easily and conveniently by various trades for receiving, displaying or storing goods, however, by virtue that receiving bins or foldable receiving bins used presently are disadvantageous in structural designs thereof, they make trouble and inconvenience in transportation, storage and using to leave trouble to the traders, and improvement is required.

SUMMARY OF THE INVENTION

The inventor studied, improved and developed the present invention with very large amount of mind and effort after repeated experiments, examinations and tests based on his practical experience of years in designing, production and selling of the products of such kind. A plurality of engaging means are provided on the two foldable plates, two lateral side plates, the cover plate, the upper frame and the lower base plate of a foldable receiving bin of the present invention, so that when the foldable receiving bin is unfolded for use or is folded for storage, it can both be structurally fixed by engagement and fixing, thereby, the receiving bin is structurally stable and firm.

Therefore, the main object of the present invention is to provide a firmly engaging structure respectively at the covering area between the cover plate and the upper frame of a foldable receiving bin, at the joint positions of the two foldable plates and the two lateral side plates as well as at the joint positions of the two lateral side plates and the lower base plate, in order that the foldable receiving bin has a steady and consolidated framework.

The secondary object of the present invent ion is to provide engaging pieces and engaging holes respectively on the upper frame and the lower base plate of the foldable receiving bin; so that when the foldable receiving bin is folded to collapse, the upper frame and the lower base plate can be combined with each other firmly to protect the receiving bin from loosening and separating during transportation.

Another object of the present invention is to provide a plurality of engaging means on the foldable receiving bin, so that when the receiving bin is folded or unfolded, only a small force is required to lock or unlock these engaging means, the processes of assembling and collapsing are not difficult, a user can operate in a convenient way.

Another object of the present invention is to provide a pair of lugs respectively on the left and the right side plates of the foldable receiving bin, when the foldable receiving bin is unfolded for use, the lugs are exactly located respectively beneath the engaging pieces on the lateral sides of the upper frame to be used as grips during transporting goods.

The present invention will be apparent in its structure, assembling as well as the way of use after reading the detailed description of the preferred embodiment thereof in reference to the accompanying drawings.

BRIEF DESCRIPTION OF THE DRAWINGS

FIGS. 4A–C are schematic views showing engaging of the cover plate with the upper frame of the present invention;

DETAILED DESCRIPTION OF THE PREFERRED EMBODIMENT

Figure 1:
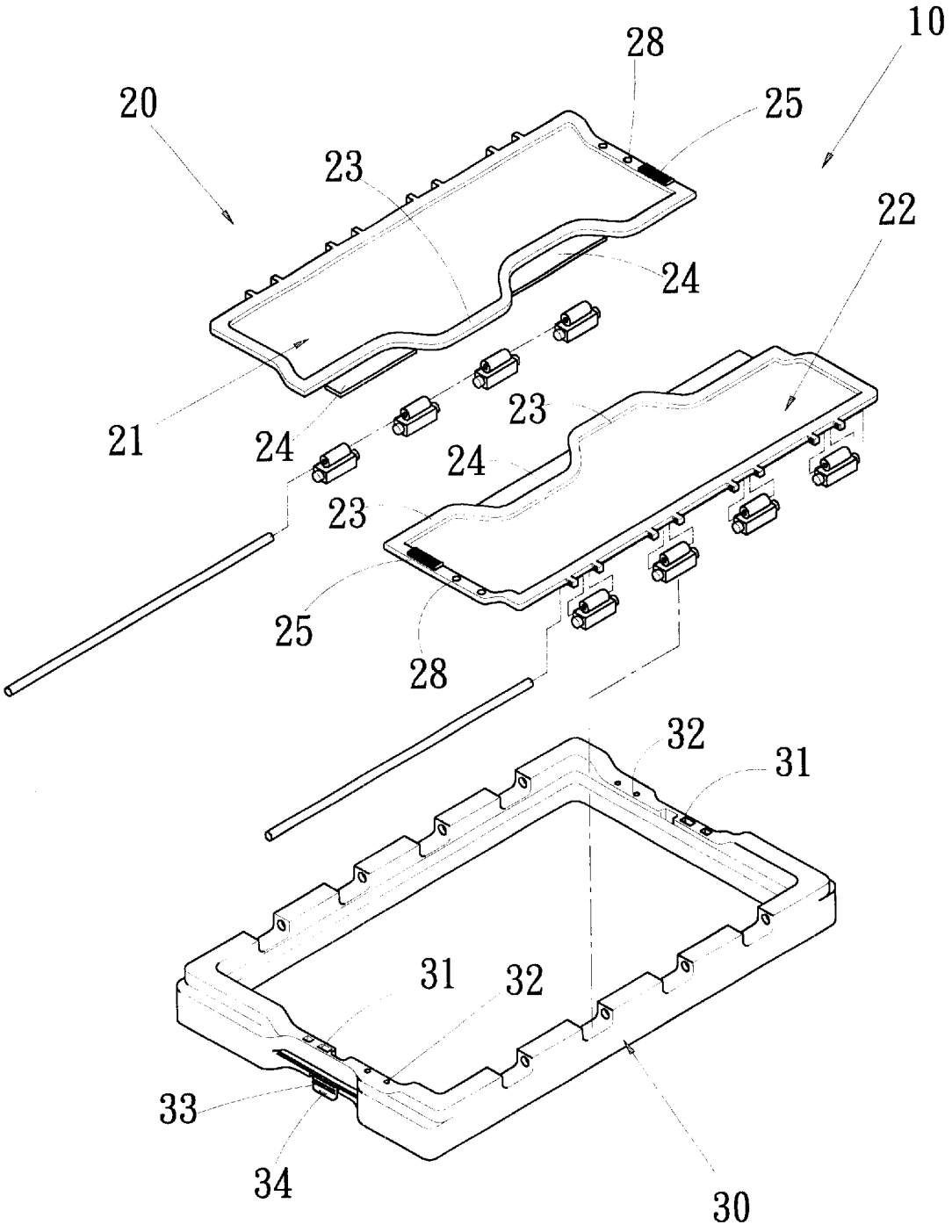
FIG. 1 is an analytic perspective view showing the cover plate and the upper frame of the foldable receiving bin of the present invention.
Figure 2:
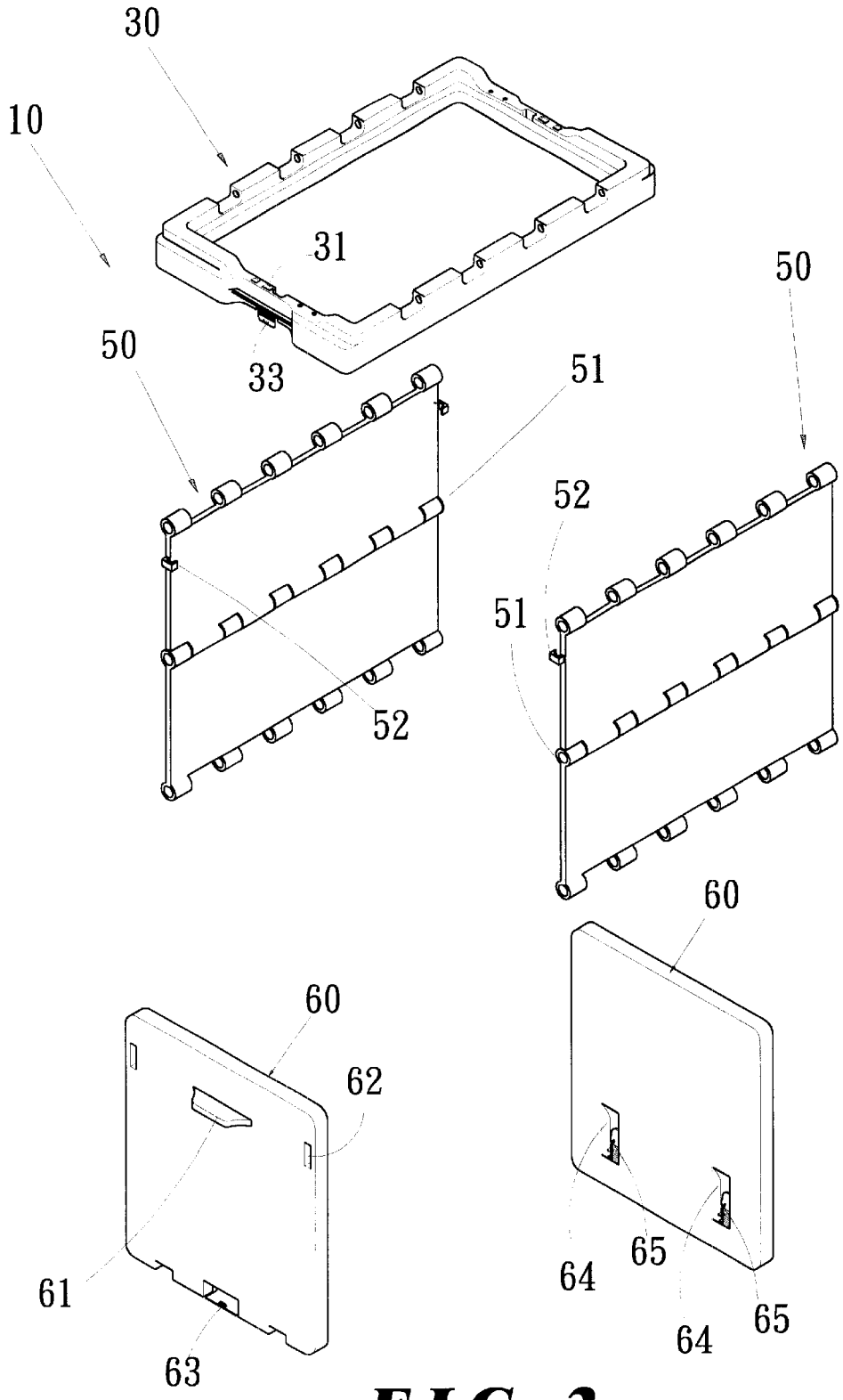
FIG. 2 is an analytic perspective view showing the upper frame and the two lateral side plates of the present invention.
Figure 3:
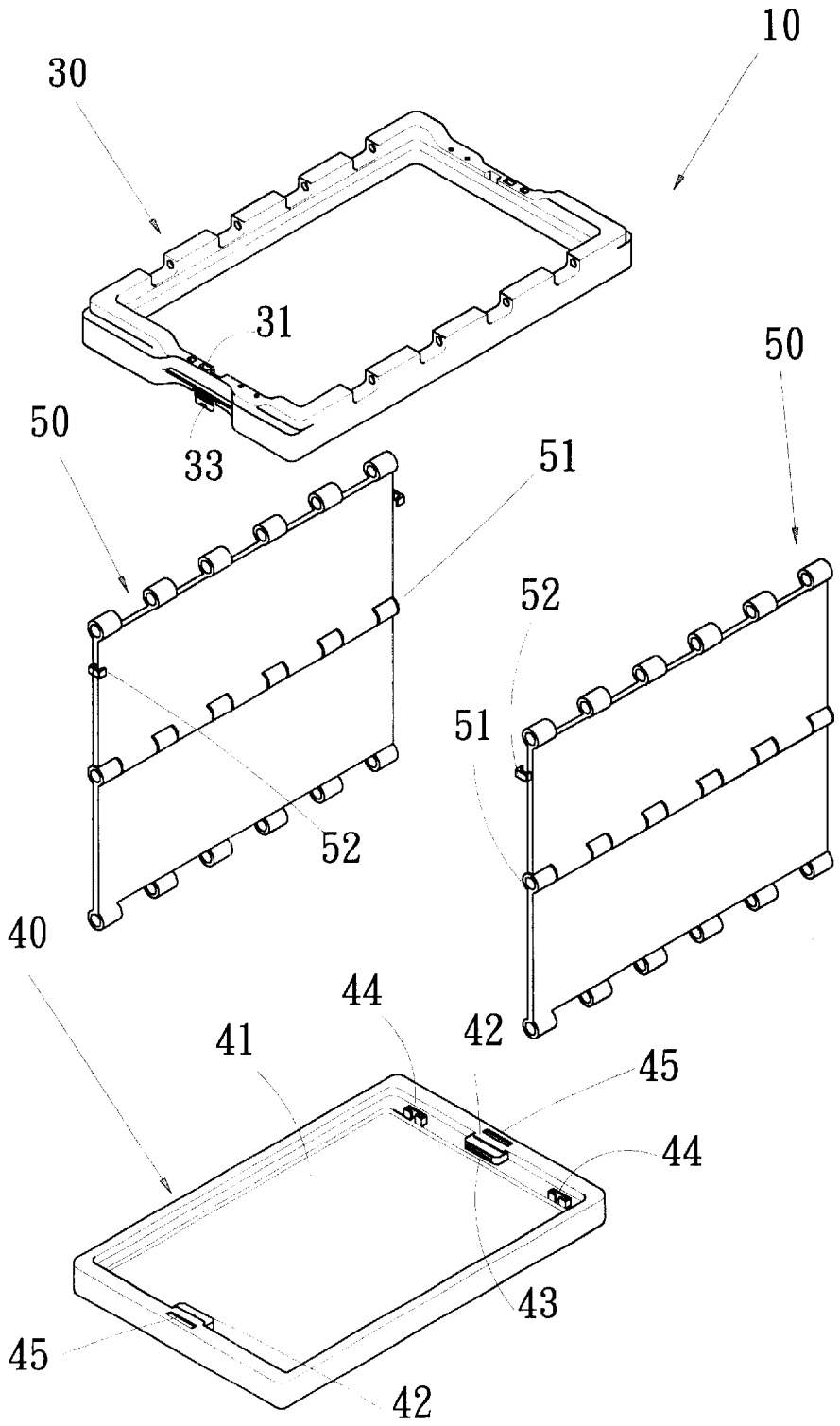
FIG. 3 is an analytic perspective view showing the upper frame, the front and rear foldable plates and the lower base plate of the present invention.

Referring to FIGS. 1, 2 and 3, the foldable receiving bin 10 of the present invention is comprised of a cover plate 20, an upper frame 30, a lower base plate 40, two foldable plates 50 and two lateral side plates 60, wherein:

The cover plate 20 is comprised of a left cover plate 21 and a right cover plate 22, and is pivotally connected to the top of the upper frame 30. The left cover plate 21 and the right cover plate 22 are connected by abutting and engaging, the connecting ends of the left and the right cover plates 21, 22 are provided respectively with a plurality of press engaging plate portions 23 and abutting plate portions 24. Each engaging plate portion 23 is stacked over and pressed against a corresponding abutting, plate portion 24 and engaged therewith. The left and the right cover plates 21, 22 are provided each on a lateral edge thereof with an engaging member 25 in the form of a pusher piece (as shown in FIG. 4 and FIGS. 4A–C). The engaging member 25 is provided at one side of it with a plurality of round holes 28, and is provided beneath it with a hooking member 26 which has a raised portion 27 on the tailing end thereof. The hooking members 26 extend respectively down and beneath the left cover plate 21 and the right cover plate 22.

The upper frame 30 is in the shape of a rectangle (as shown in FIGS. 1–3) which is hollow centrally, the rear a the front sides thereof are pivotally connected respectively with the left cover plate 21 and the right cover plate 22, and the two lateral sides thereof are provided each with an engaging hole 31 which is provided therein with a stop rod 35 (as shown in FIG. 4A), and a plurality of through holes 32 are provided on both the two lateral sides (as shown in FIGS. 1–3). The upper frame 30 is provided on each of the two lateral sides thereof with an engaging piece 33 having a protruding strip 34 thereon.

The lower base plate 40 is in the shape in correspondence with that of the upper frame 30, it has a slightly recessed receiving space 41 therein with an engaging member 42 provided respectively on the front and the rear sides of the lower base plate 40. The engaging member 42 is provided on the lateral side thereof with an engaging hole 43; and is provided at the sides thereof with engaging seats 44. The lower base plate 40 is further provided respectively on each of the front and the rear sides thereof externally of the engaging members 42 with an engaging hole 45.

The two foldable plates 50 are symmetrical with respect to each other, and are provided each in the middle thereof with a pivot 51. The two foldable plates 50 can be unfolded to their upright positions or folded to collapse, and are provided on both lateral sides thereof with hooks 52. The upper and the lower ends of the two foldable plates 50 are connected respectively to the upper frame 30 and the lower base plate 40; when the two foldable plates 50 are stretched out, they can support at the front and rear sides of the upper frame 30; and when they are folded, they can be received in the recessed receiving space 41 of the lower base plate 40.

Figure 6:
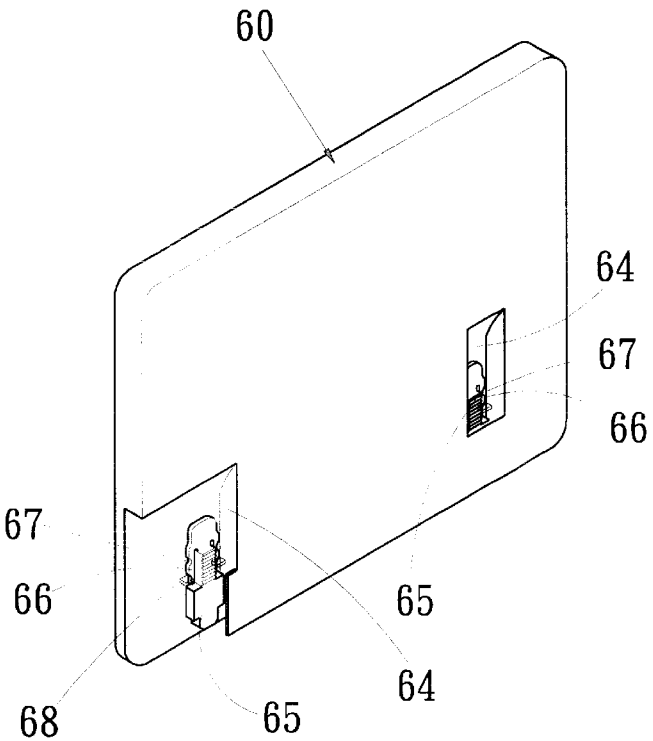
FIG. 6 is a perspective view showing the inner side of the left or the right side plate of the foldable receiving bin of the present invention.
Figure 5:
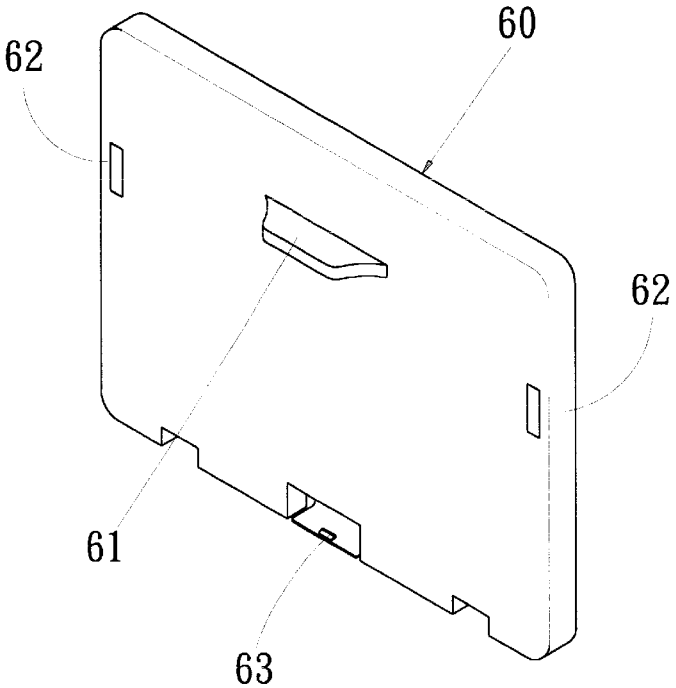
FIG. 5 is a perspective view showing the outer side of the left or the right side plate of the foldable receiving bin of the present invention.
Figure 7:
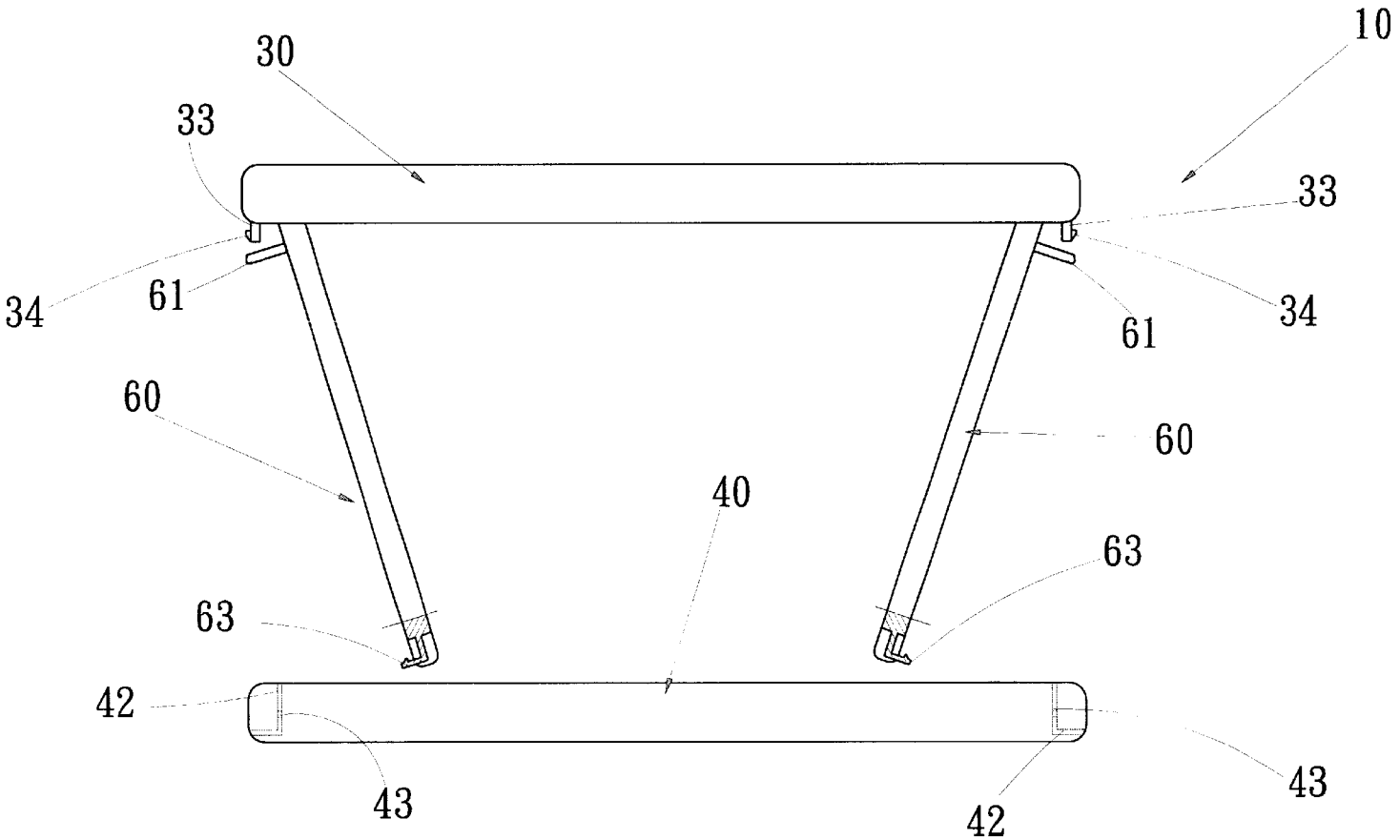
FIG. 7 is a schematic view showing assembling of the upper frame with the two lateral side plates and the lower base plate of the present invention.

The two lateral side plates 60 are each in the shape of a plain plate (as shown in FIGS. 5–7), the upper ends thereof are pivotally connected to the bottom side of the upper frame 30 to be movably hung thereon. The two lateral side plates 60 are provided at the upper positions on the external surfaces thereof each with a lug 61, and are provided each at the front and rear sides thereof with two recessed engaging slots 62, on the middle bottom edges thereof each with a protruding engaging piece 63. The two lateral side plates 60 are further provided each at the lower portion near the front and rear sides thereof with two slide grooves 64 which each has an engaging slide member 65 therein (FIG. 6 is exploded at the left lower corner thereof to show the structures of and relationship between a slide groove 64 and its corresponding engaging slide member 65), the engaging slide member 65 is straddled at both sides thereof with an elastic engaging rod 66 on which there are a plurality of concave portions 67 to engage with a pair of protruding engaging portions 68 provided on the wall of the corresponding slide groove 64 for positioning and mutual engaging, and the engaging slide member 65 can move up and down in its corresponding slide groove 64.

Figure 4:
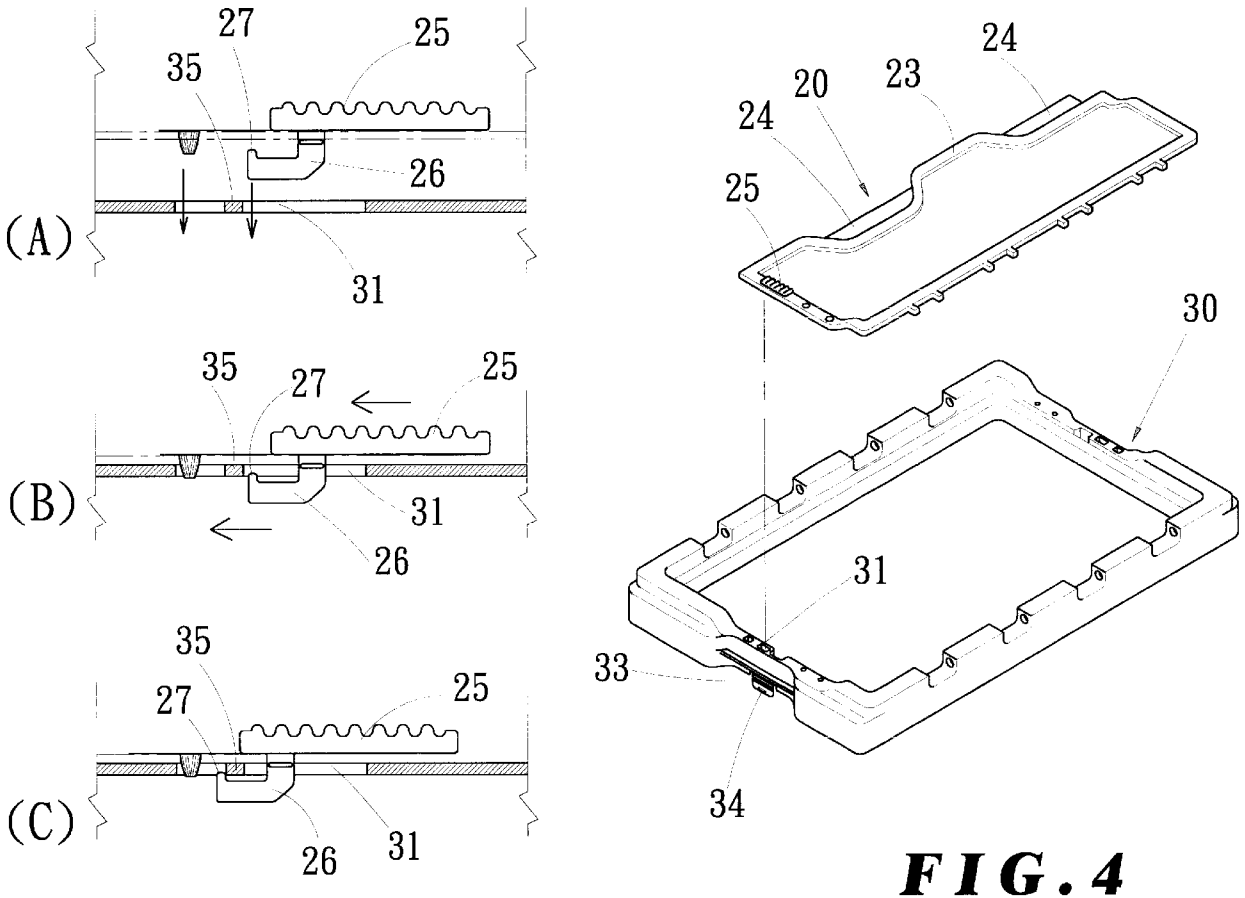
FIG. 4 is a perspective view showing assembling of the cover plate and the upper frame of the present invention.
Figure 8:
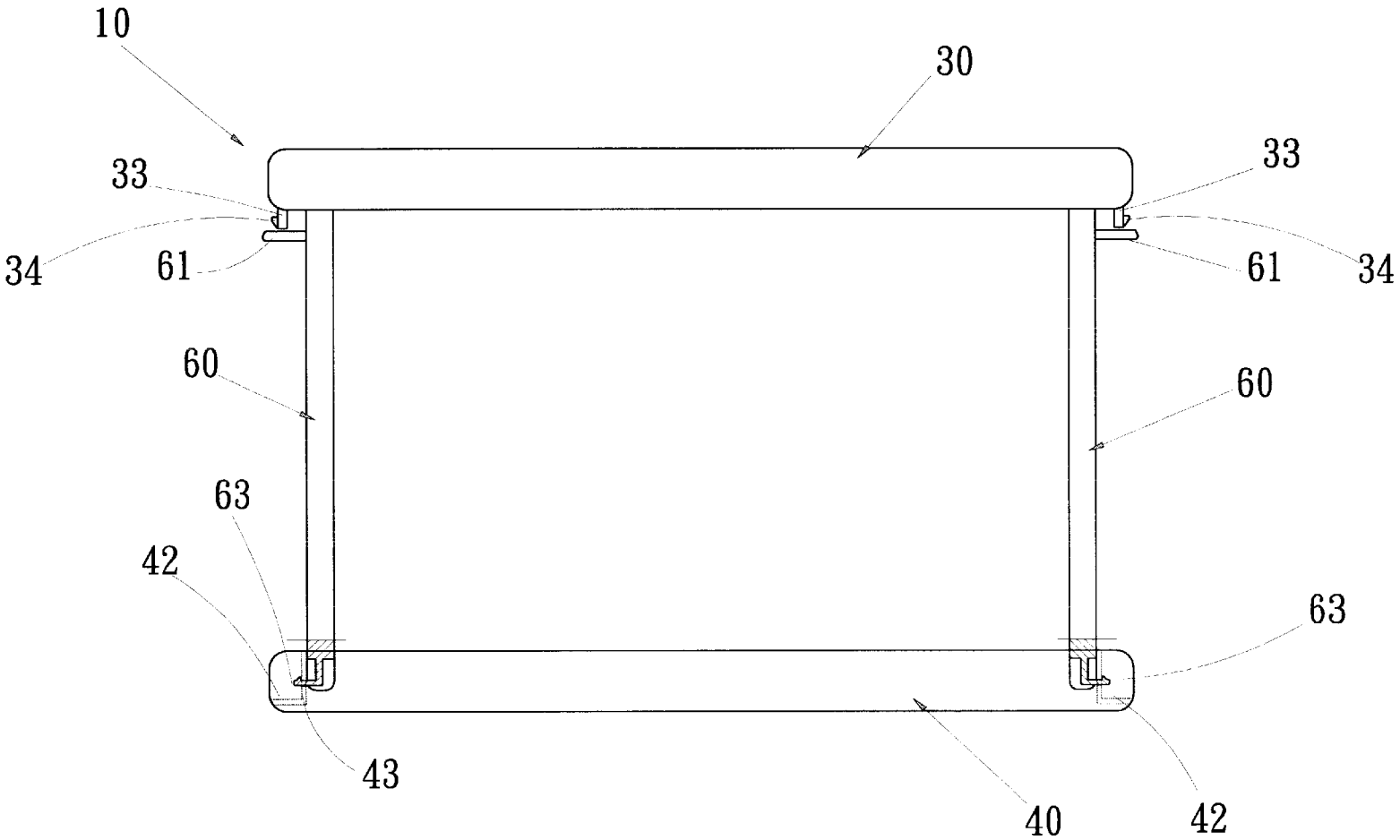
FIG. 8 is a schematic view showing completion of assembling of the upper frame with the two lateral side plates and the lower base plate of the present invention.
Figure 9:
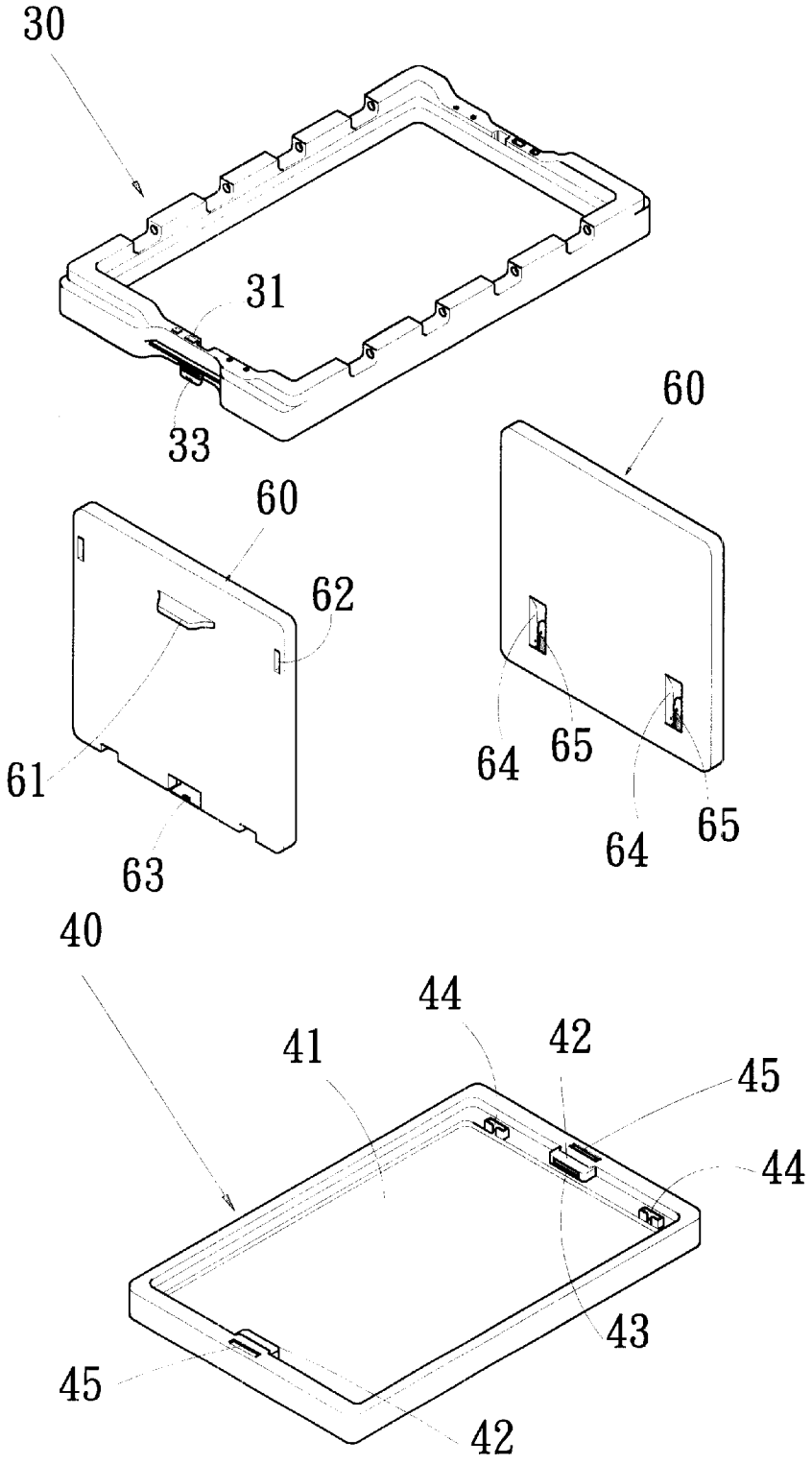
FIG. 9 is an analytic perspective view showing the upper frame, the two lateral side plates and the lower base plate of the present invention.
Figure 10:
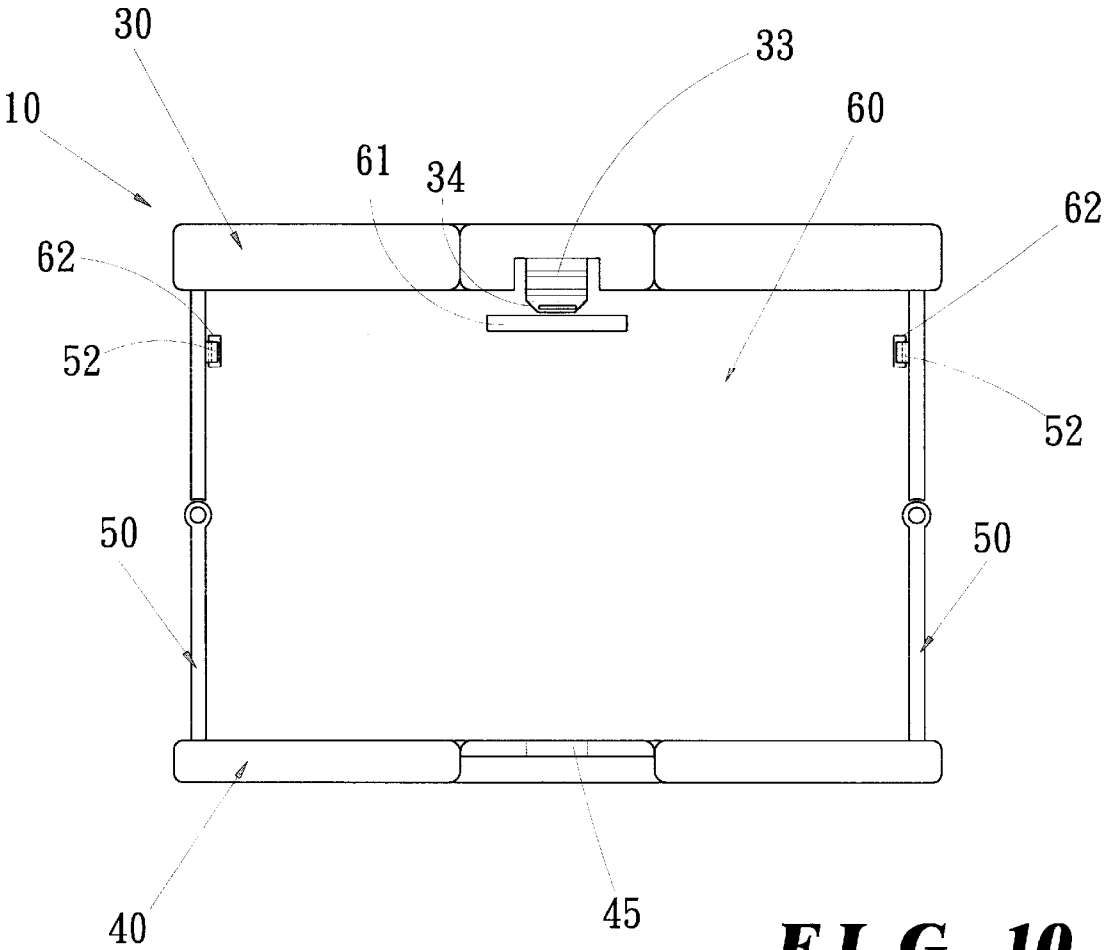
FIG. 10 is a schematic view showing assembling of the front and rear foldable plates with the two lateral side plates of the present invention.

With the above stated members, when the foldable receiving bin 10 is unfolded for use, the upper frame 30 is lifted (as shown in FIGS. 7 and 8) to render the two foldable plates 50 upright, then the two lateral side plates 60 are adjusted to their proper positions leftwards and rightwards, and the lugs 61 on the two lateral side plates 60 are abutted upwardly against the lower ends of the engaging pieces 33 of the upper frame 30 to respectively form two grips to be gripped with hands. The recessed engaging slots 62 on the two lateral side plates 60 are provided for hooking engaging of the hooks 52 of the two foldable plates 50 therein (as shown in FIGS. 9 and 10), therefore, the connections of the two lateral side plates 60 with the two foldable plates 50 are made by means of the hooks 52 and the recessed engaging slots 62. The protruding engaging pieces 63 on the bottoms of the two lateral side plates 60 (as shown in FIGS. 7, 8 and 9) are engaged respectively in the engaging holes 43 of the engaging members 42 within the recessed receiving space 41 in the lower base plate 40; then the engaging slide members 65 in their corresponding slide grooves 64 provided at the lower port ions near the front and rear sides of the two lateral side plates 60 are move downwardly to engage the lower ends of the engaging slide members 65 respectively into the engaging seats 44 of the lower base plate 40. And by engaging and positioning of the two lateral side plates 60 and the lower base plate 40, the four sides of each of the two lateral side plates 60 are all restrained and fixed, and all the connecting areas of the foldable receiving bin 10 of the present invention are firmly positioned and engaged. The upper cover plate 20 of the foldable receiving bin 10 (as shown in FIGS. 1 and 4) has the left cover plate 21 and the right cover plate 22 thereof put on the upper frame 30 with the engaging members 25 on the lateral edges of the left cover plate 21 and the right cover plate 22 exactly on the engaging holes 31 of the upper frame 30, and more, the hooking members 26 provided respectively beneath the engaging members 25 can be engaged in the engaging holes 31. Therefore, by pushing the engaging members 25 to displace, the hooking members 26 have their raised portions 27 on the tailing ends thereof engaged with the stop rods 35 provided in the engaging holes 31. In this way, the left and the right cover plates 21, 22 are fixed on the upper frame 30 to tightly cover the foldable receiving bin 10.

When the left and the right cover plates 21, 22 of the cover plate 20 cover the upper frame 30 taking advantage of the round holes 28 provided at one side of the engaging members 25, the round holes 28 are exactly aligned and communicated with the through holes 32 provided on the upper frame 30; therefore, ropes or lines can be extended through the round holes 28 and the through holes 32 to tie the cover plate 20 tightly on the upper frame 30.

Figure 11:
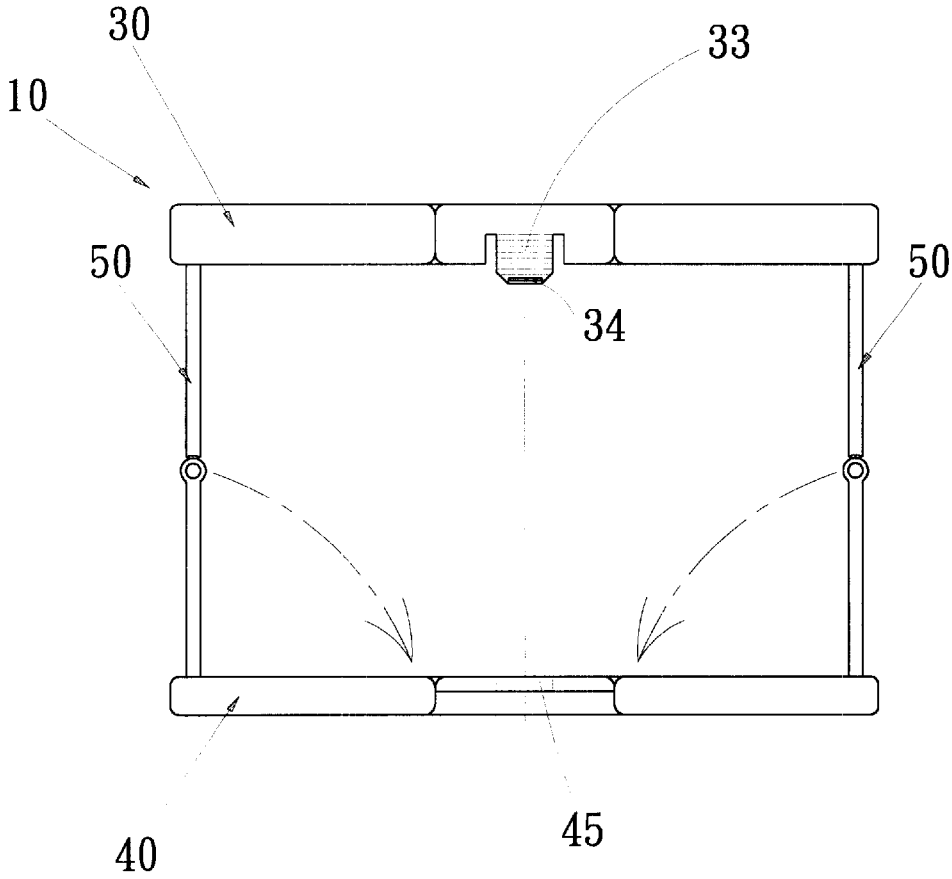
FIG. 11 is a schematic view showing folding of the front and rear foldable plates of the present invention.
Figure 12:
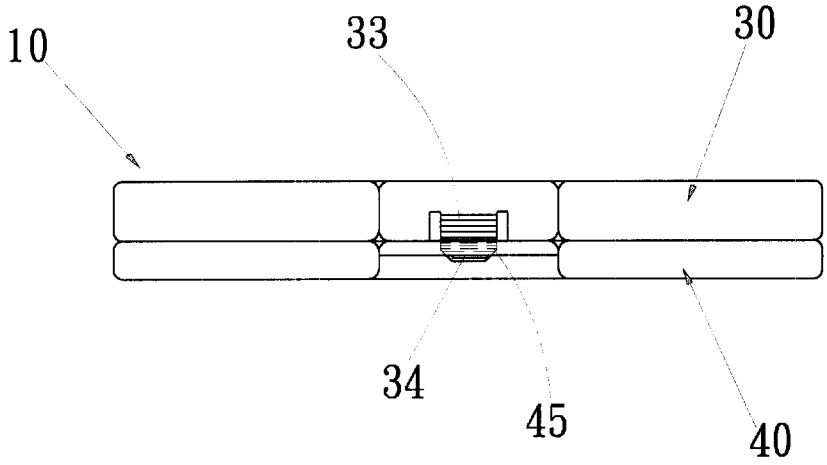
FIG. 12 is a schematic view showing folding of the upper frame and the lower base plate of the present invention.

When in collapsing of the foldable receiving bin 10 (as shown in FIGS. 10, 11 and 12), the two foldable plates 50 at the front and rear sides are respectively collapsed to get in the recessed receiving space 41 of the lower base plate 40; while the two lateral side plates 60 are folded upwardly to abut against the upper frame 30. Then the upper frame 30 is pressed to stack on the lower base plate 40 by engaging of the engaging pieces 33 provided on the two lateral sides of the upper frame 30 in the engaging holes 45 of the lower base plate 40. In this way, the upper frame 30 is fixedly engaged on the lower base plate 40 to thereby reduce volume of the foldable receiving bin 10. Further by engaging of the engaging pieces 33 in the engaging holes 45, the upper frame 30 is combined with the lower base plate 40 to prevent loosening during transportation.

In conclusion, there are engaging members provided for all the side plates of the foldable receiving bin of the present invention, so that when the foldable receiving bin is assembled, all the connecting areas are engaged and fixed, the foldable receiving bin thus is structurally firmer. When in collapsing of the foldable receiving bin, firm engaging of the upper frame with the lower base plate makes reduced volume of the foldable receiving bin, no loosening will occur during transportation. This effectively improves the structure for foldable receiving bins. Having thus described my invention, what I claim as new and desire to be secured by Letters Patent of the United States are:

Claims

1. An improved structure of foldable receiving bin, said foldable receiving bin comprises a cover plate, an upper frame, a lower base plate, two foldable plates and two lateral side plates, wherein:

said cover plate is comprised of a left cover plate and a right cover plate, and is pivotally connected to the top of said upper frame; said left and said right cover plates are connected by abutting and engaging, and are provided each on a lateral edge thereof with an engaging member in the form of a pusher piece, said engaging member is provided at one side of it with a plurality of round holes, and is provided beneath it with a hooking member which extends down and beneath said left cover plate or said right cover plate corresponding thereto;

said upper frame is in the shape of a rectangle which is hollow centrally, the rear and the front sides thereof are pivotally connected respectively with said left cover plate and said right cover plate, and two lateral sides of said upper frame are provided each with an engaging hole, and a plurality of through holes are provided on both said lateral sides; said upper frame is provided on each of said two lateral sides thereof with an engaging piece having a protruding strip thereon; said two foldable plates are pivotally connected to said front and rear sides respectively of said upper frame, while said two lateral side plates are pivotally connected to said lateral sides of said upper frame;

said two foldable plates are symmetrical with respect to each other, and are provided each in the middle thereof with a pivot, said two foldable plates thus are adapted to unfolding to their upright positions or folding to collapse. and are provided on both lateral sides thereof with hooks;

the upper ends of said two lateral side plates are pivotally connected to the bottom side of said upper frame; said two lateral side plates are provided at the upper positions on the external surfaces thereof each with a lug, and are provided each at the front and rear sides thereof with recessed engaging slots, on the middle bottom edges thereof each with a protruding engaging piece; said two lateral side plates are further provided each at the lower portion near the front and rear sides thereof with two slide grooves which each has an engaging slide member therein, said engaging slide member is straddled at both sides thereof with an elastic engaging rod on which there are a plurality of concave portions to engage with a pair of protruding engaging portions provided on the wall of the corresponding one of said slide grooves for mutual engaging and positioning;

when said foldable receiving bin is unfolded for use, said upper frame is lifted to render said two foldable plates upright, then said two lateral side plates are adjusted to their proper positions leftwards and rightwards, said upper cover plate on said foldable receiving bin has said left and the right cover plates fixed on said upper frame in assembling said foldable receiving bin.

2. An improved structure of foldable receiving bin as in claim 1, wherein:

when in collapsing of said foldable receiving bin, said two foldable plates are respectively collapsed to get in said recessed receiving space of said lower base plate; while said two lateral side plates are folded upwardly to abut against said upper frame, then said upper frame is pressed to stack on said lower base plate, by engaging of said engaging pieces provided on said two lateral sides of said upper frame in said engaging holes of said lower base plate, said upper frame is fixedly engaged on said lower base plate to thereby reduce volume of said foldable receiving bin.

3. An improved structure of foldable receiving bin as in claim 1, wherein:

when said two lateral side plates are adjusted to their proper positions leftwards and rightwards, said lugs on said two lateral side plates are abutted upwardly against the lower ends of said engaging pieces of said upper frame respectively to form two grips to be gripped with hands.

4. An improved structure of foldable receiving bin as in claim 1, wherein:

said recessed engaging slots on said two lateral side plates are provided for hooking engaging of said hooks of said two foldable plates therein, therefore, the connections of said two lateral side plates with said two foldable plates are made consolidated.

5. An improved structure of foldable receiving bin as in claim 1, wherein:

said protruding engaging pieces on the bottoms of said two lateral side plates are engaged respectively in said engaging holes of said engaging members within said recessed receiving space in said lower base plate; then said engaging slide members in their corresponding ones of said slide grooves provided at the lower portions near the front and rear sides of said two lateral side plates are move downwardly to engage the lower ends of said engaging slide members respectively into said engaging seats of said lower base plate.

6. An improved structure of foldable receiving bin as in claim 1, wherein:

said upper cover plate of said foldable receiving bin has said left cover plate and said right cover plate thereof put on said upper frame with said engaging members on the lateral edges of said left cover plate and said right cover plate exactly on said engaging holes of said upper frame, and more, said hooking members provided respectively beneath said engaging members are adapted to engaging in said engaging holes, therefore; by pushing said engaging members to displace, said hooking members have their raised portions on the tailing ends thereof engaged with stop rods provided in said engaging holes, in this way, said left and the right cover plates are fixed on said upper frame to tightly cover said foldable receiving bin.

7. An improved structure of foldable receiving bin as in claim 1, wherein:

said connecting ends of said left cover plate and said right cover plate are provided respectively with a plurality of press engaging plate portions and abutting plate portions, each of said engaging plate portions is stacked over and pressed against a corresponding one of said abutting plate portions and engaged therewith.

* * * * *